US007748179B2

(12) United States Patent
Schiedegger et al.

(10) Patent No.: US 7,748,179 B2
(45) Date of Patent: Jul. 6, 2010

(54) DECORATIVE MOLDING

(75) Inventors: Charles E. Schiedegger, Metamora, MI (US); Clyde G. Allen, Lapeer, MI (US); Dean Dennis, Lapeer, MI (US)

(73) Assignee: Tapco International Corporation, Wixom, MI (US)

( * ) Notice: Subject to any disclaimer, the term of this patent is extended or adjusted under 35 U.S.C. 154(b) by 675 days.

(21) Appl. No.: 11/035,315

(22) Filed: Jan. 14, 2005

(65) Prior Publication Data

US 2005/0193640 A1 Sep. 8, 2005

Related U.S. Application Data

(60) Provisional application No. 60/536,927, filed on Jan. 16, 2004.

(51) Int. Cl.
*E06B 1/04* (2006.01)
*E04F 19/00* (2006.01)
*E04C 2/38* (2006.01)

(52) U.S. Cl. ..... 52/211; 52/717.05; 52/311.2; 52/716.1; 52/212

(58) Field of Classification Search ..... 52/211, 52/212, 287.1, 288.1, 311.1, 311.2, 716.1, 52/718.01, 718.04, 717.05, 717.04, 36.3, 52/717.01, 718.02; D23/403, 343–345; 126/500; 49/504; 248/345.1; D25/135–137
See application file for complete search history.

(56) References Cited

U.S. PATENT DOCUMENTS 346,187 A 7/1886 Boda
385,233 A 6/1888 Boda
432,553 A 7/1890 Ohmer
866,479 A 9/1907 Kiesel, Jr.
1,150,790 A 8/1915 Swanson
1,229,765 A 6/1917 Lehman
1,424,658 A 8/1922 Lidstone
1,426,277 A 8/1922 Conant
2,069,289 A 2/1937 Swednsen et al.
2,342,893 A 2/1944 Purcell et al.

(Continued)

FOREIGN PATENT DOCUMENTS

BE 679523 10/1966

(Continued)

*Primary Examiner*—Richard E Chilcot, Jr.
*Assistant Examiner*—Elizabeth A Plummer
(74) *Attorney, Agent, or Firm*—Howard & Howard Attorneys PLLC

(57) ABSTRACT

The invention includes an end cover (32) for disposition over an end of a mantel (20). The end cover (32) presents a front corner (38) extending between an upper wall (34) and a lower wall (36) and is symmetrical rearwardly to a pair of side edges (42) from the front corner (38) whereby the end cover (32) may be disposed over either end of the mantel (20). The upper wall (34) of the end cover (32) extends between the front walls (44) and the side edges (42) and the lower wall (36) extends between the front walls (44) and the side edges (42). The upper wall (34) and the lower wall (36) each has the shape of a square with equal sides. The front walls (44) define interior surfaces complementary to the irregular pattern of the decorative face (24) of the mantel (20) and the end cover (32) overlies the mantel (20) the thickness of each front wall (44).

10 Claims, 6 Drawing Sheets

U.S. PATENT DOCUMENTS

| | | | | |
|---|---|---|---|---|
| 3,139,703 | A | 7/1964 | Hilt | |
| 3,295,277 | A | 1/1967 | Potter et al. | |
| 3,449,873 | A | 6/1969 | Damato et al. | |
| 3,464,177 | A | 9/1969 | Amato | |
| 3,590,541 | A | 7/1971 | Epstein | |
| 3,609,928 | A | 10/1971 | Mock | |
| 3,657,848 | A | 4/1972 | Davidson | |
| 3,750,728 | A | 8/1973 | Stark | |
| 3,778,945 | A | 12/1973 | Medow | |
| 3,974,606 | A | 8/1976 | LaBorde | |
| 4,000,597 | A | 1/1977 | Burton | |
| 4,228,630 | A | 10/1980 | Englert et al. | |
| 4,423,575 | A | 1/1984 | Lagergren et al. | |
| 4,590,723 | A | 5/1986 | Nassau et al. | |
| 4,608,800 | A | 9/1986 | Fredette | |
| 4,803,815 | A | 2/1989 | Burgers | |
| 4,843,771 | A | 7/1989 | Chapman et al. | |
| 5,179,811 | A | 1/1993 | Walker et al. | |
| 5,199,237 | A | 4/1993 | Juntunen | |
| 5,222,343 | A | 6/1993 | Anderson | |
| 5,274,972 | A | 1/1994 | Hansen | |
| 5,426,901 | A | 6/1995 | Indracek | |
| 5,444,954 | A | 8/1995 | Anderson | |
| 5,551,201 | A | 9/1996 | Anderson | |
| 5,564,233 | A | 10/1996 | Norton | |
| 5,579,617 | A | 12/1996 | Schiedegger et al. | |
| 5,581,970 | A | 12/1996 | O'Shea | |
| 5,625,992 | A | 5/1997 | Strick et al. | |
| 5,655,588 | A | 8/1997 | Lamont et al. | |
| 5,711,123 | A | 1/1998 | Lamont et al. | |
| 5,802,790 | A | 9/1998 | Lamont et al. | |
| 6,076,329 | A * | 6/2000 | Thomson | 52/785.1 |
| 6,112,481 | A | 9/2000 | Schiedegger et al. | |
| 6,212,835 | B1 | 4/2001 | Schiedegger et al. | |
| 6,276,101 | B1 | 8/2001 | Schiedegger et al. | |
| 6,463,707 | B1 | 10/2002 | Schiedegger et al. | |
| 6,643,990 | B2 | 11/2003 | Jensen | |
| 6,725,614 | B2 | 4/2004 | Schiedegger et al. | |
| 6,837,020 | B1 * | 1/2005 | Keddell | 52/745.2 |
| 2002/0166299 | A1 * | 11/2002 | Day | 52/211 |
| 2003/0101667 | A1 * | 6/2003 | Yoder | 52/211 |
| 2004/0172897 | A1 * | 9/2004 | Pickup | 52/288.1 |

FOREIGN PATENT DOCUMENTS

| | | | |
|---|---|---|---|
| DE | 25 57 057 | | 12/1975 |
| DE | 41 38 207 | A1 | 11/1991 |
| WO | WO02099224 | A1 * | 12/2002 |

* cited by examiner

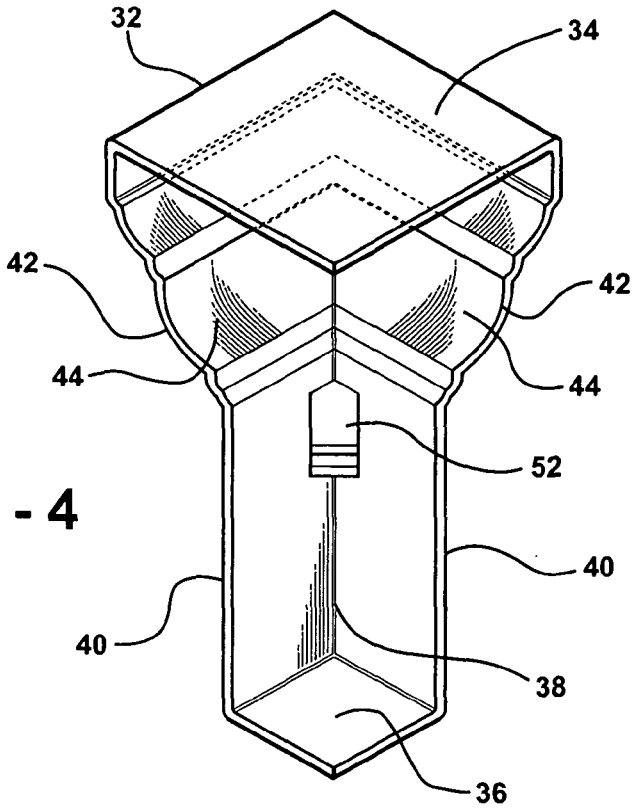
FIG - 4
FIG - 5
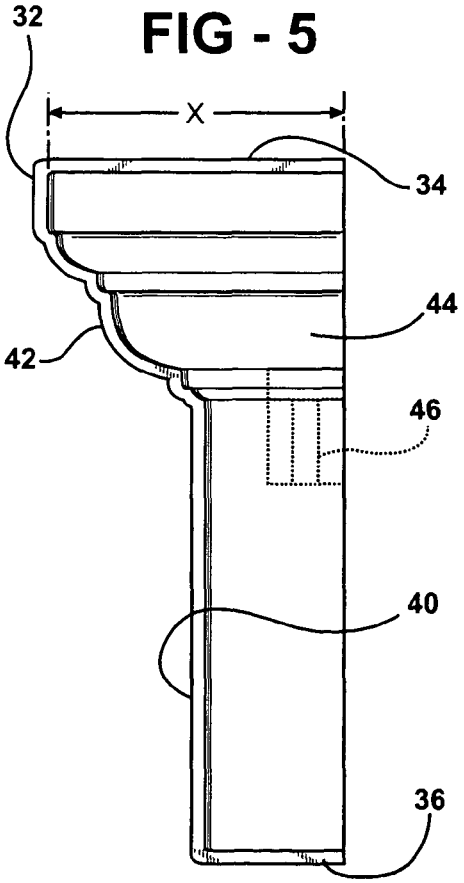
FIG - 6
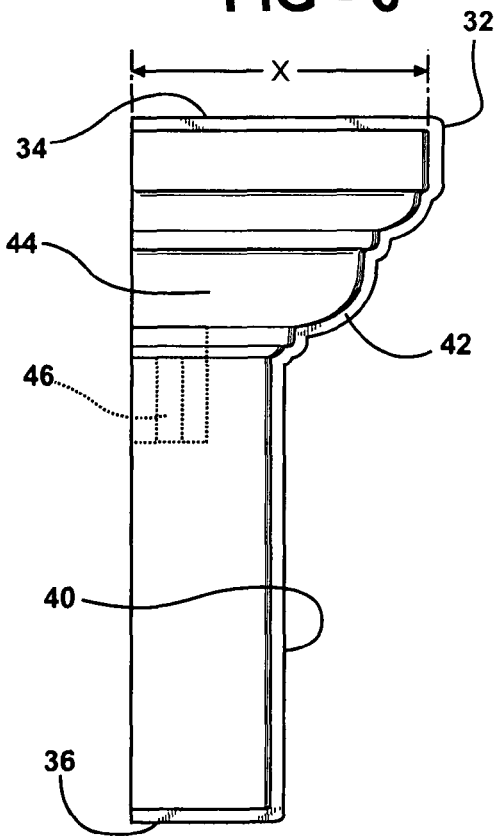

DECORATIVE MOLDING

CROSS REFERENCE TO RELATED APPLICATION

This application claims the benefit of U.S. provisional application Ser. No. 60/536,927 filed Jan. 16, 2004.

BACKGROUND OF THE INVENTION

1. Field of the Invention

The subject invention relates to decorative exterior trim assembly for use in a surround for openings of residential or commercial structures, and more particularly to a decorative molding apparatus for heading a doorway, window, patio door, garage door opening, etc. of a residential or commercial structure.

2. Description of the Related Art

Molding assemblies are used in a variety of applications to frame or head opening such as doorways, windows, patio doors, garage doors etc., to provide a decorative, aesthetically appealing look for an opening of a structure. Such assemblies typically include a mantel extending along a longitudinal axis between ends for mounting against a mounting plane above the opening in the building to present a decorative face spaced forwardly from the mounting plane a decorative distance.

In recent years, these decorative molding assemblies have been manufactured from plastics such as high-density polyurethane. In general, plastics provide significant advantages over natural wood. For example, decorative molding assemblies or components thereof manufactured from plastic are low in maintenance when compared with natural wood molding assemblies. Plastic molding assemblies are not susceptible to moisture and therefore will not decay, warp or splinter like natural wood. However, there is still a need to divert water away from the opening and structure.

Advantageously, plastic decorative molding assemblies or components thereof can be sawed, drilled, glued or nailed just like natural wood. Still further, during the manufacture of plastic molding assemblies, plastic can be tinted with dyes or other materials to provide molding assembly components which are of desired colors, thus obviating the need for painting prior or subsequent to installation on a structure.

Many lengths of the mantel are required to accommodate various opening sizes. The mantels are cut to provide the desired length and end covers are placed over the cut ends to conceal the open end and to maintain the decorative and aesthetic appearance of the mantel. These end-covers were made specifically for each end, i.e., a left or right end. The requirement for left and right end-covers increases the number of components to the assembly and the manufacturing tooling required for producing the assembly.

SUMMARY OF THE INVENTION AND ADVANTAGES

The invention provides for the end cover having a top and a bottom and presenting a front corner extending between the top and the bottom and being symmetrical from the front corner whereby the end cover may be disposed over either end of the mantel.

The subject invention provides a mantel or header molding having a mounting base, decorative cover or mantel and end-cover. The mounting base and decorative mantel can be formed to many lengths, ultimately allowing the user to cut the mantel molding to a desired length, after which the single end cover of the subject invention may be added to either end.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 4 is a perspective view of the end cover;

FIGS. 5 and 6 are elevational views from the rear of the end cover and taken ninety degrees apart to show the symmetry of the end cover;

DETAILED DESCRIPTION OF THE PREFERRED EMBODIMENT

Figure 1:
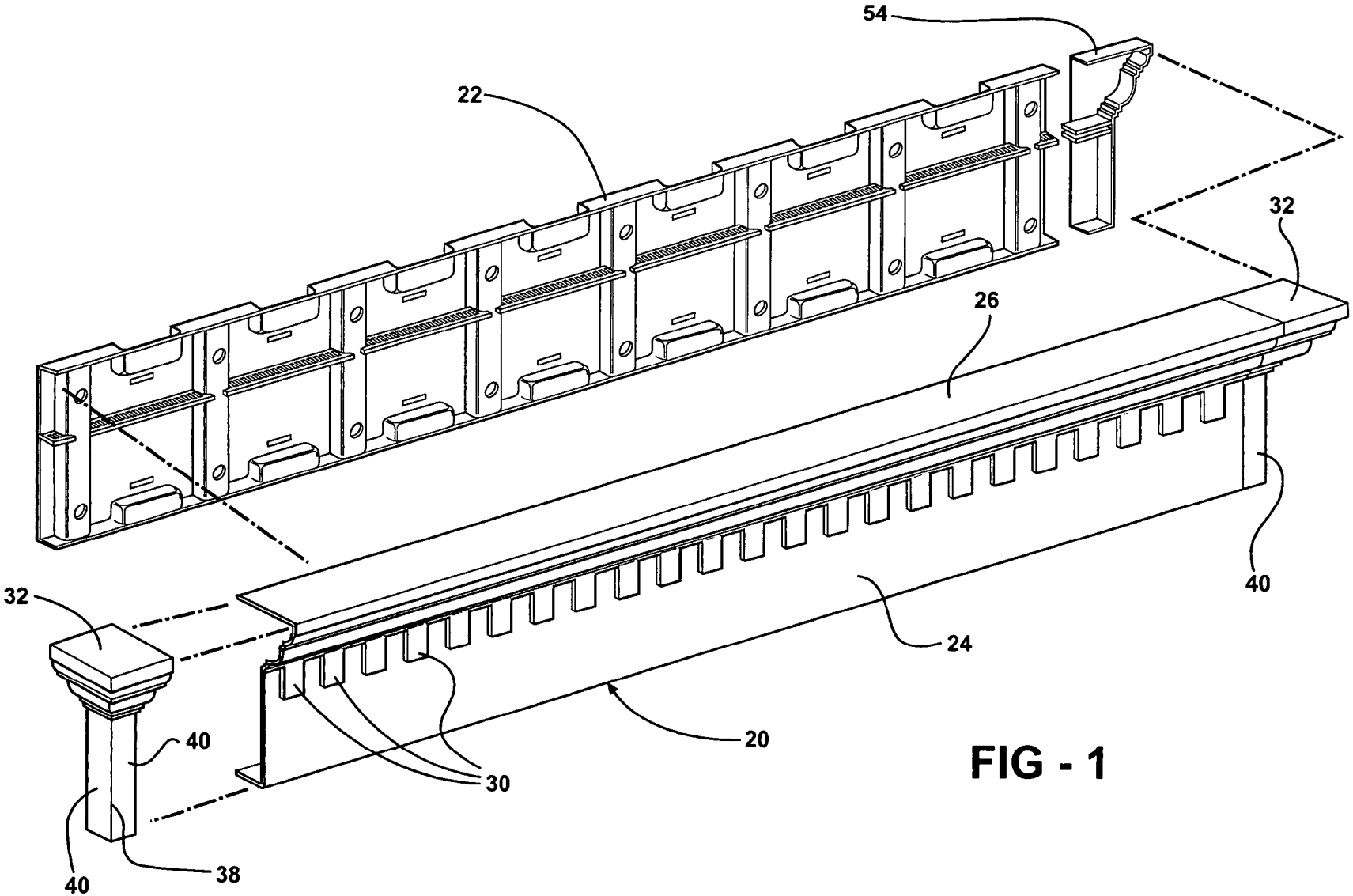
FIG. 1 is an exploded perspective view of a trim assembly for disposition over an opening in a building and incorporating the subject invention.
Figure 2:
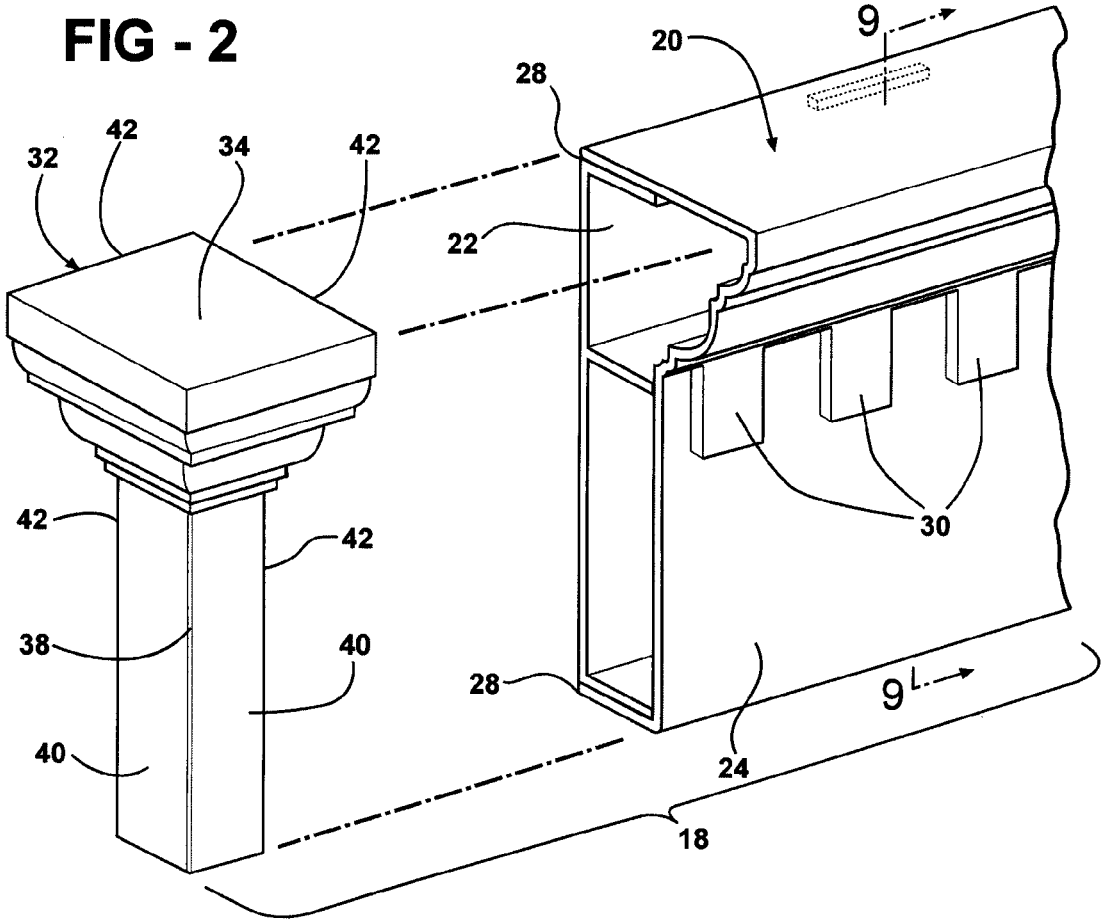
FIG. 2 is an exploded perspective view showing the end cover of the subject invention separated from the mantel and base.

An exterior trim assembly for use in a surround of an opening in a building and is generally shown in FIG. 1. The assembly includes a mantel, generally indicated at 20, extending along a longitudinal axis between open ends and a base 22 for attachment to a support structure for mounting the mantel 20 above the opening in the building. The mantel 20 is mounted on the base 22 by mechanical snap and lock mechanisms integrally formed in the respective mantel 20 and base 22 and illustrations of mechanical snap-on devices for snapping the mantel 20 onto the base 22 are more specifically described in U.S. Patent, assigned to the assignee of the subject application.

The exterior trim assembly is made from a plastic material, such as high density polyurethane. The mantel 20 and base 22 are of such geometry to allow for ease of manufacturing by a molding process, such as extrusion, to a standard length. The standard length, of the mantel 20 and the base 22, reduces the tooling required to manufacture the exterior trim, thereby reducing the manufacturing and processing expense allowing the user cut the mantel 20 and base 22 to the desired length.

The mantel 20 defines a rear mounting plane and a decorative face 24 spaced forwardly from the plane a decorative distance (X). More specifically, the mantel 20 includes a ledge 26 extending from the decorative face 24 rearwardly to a lip 28 defining the rear mounting plane, i.e., the surface of the building adjacent the base 22 engages the lip 28 to define the mounting plane. The decorative face 24 extends downwardly from the ledge 26 in an irregular pattern having different distances from the mounting plane. The ledge 26 defines the widest part of the mantel 20 as the decorative face 24 of the mantel 20 decreases in distance from the mounting plane downwardly from the ledge 26, i.e, in the fashion of a crown molding. In addition, the mantel 20 includes protrusions 30 spaced in a line along the decorative face 24 and between the ends thereof, the protrusions 30 being spaced rectangles formed integrally with the decorative face 24. The ledge 26 can be sloped downward to allow for drainage away from the structure. However, it is appreciated that those skilled in the art would recognize other ways to drain water off of the ledge 26 of the mantel 20.

The invention includes an end cover 32 for disposition over an end of the mantel 20 that includes a top defined by an upper wall 34 and a bottom defined by a lower wall 36. The end cover 32 presents a front corner 38 extending between the upper wall 34 and the lower wall 36 and is symmetrical rearwardly from the front corner 38 whereby the end cover 32 may be disposed over either end of the mantel 20. The end cover 32 includes two front surfaces 40 extending from the front corner 38 to a respective pair of side edges 42. The distance perpendicular to either of the front surfaces 40 from the front corner 38 to a position aligned with either of the edges being equal to the decorative distance (X). The upper wall 34 at the top of the end cover 32 extends between the front surfaces 40 and the side edges 42 and the lower wall 36 at the bottom extends between the front surfaces 40 and the side edges 42. The upper wall 34 and the lower wall 36 each has the shape of a parallelogram with equal sides. As illustrated, each parallelogram defines a square, albeit, squares of different areas between the top and bottom. The end cover 32 has a symmetry that allows the end cover 32 to be used on either end, i.e., the left or right end. The universal use of the end cover 32 reduces the number of components and allows the end user to cut the mantel 20 and base 22 to the desired length, and conceal the cut with the end cover 32. The reduction in parts reduces the manufacturing and processing thereby lowering the cost to manufacture and process the trim assembly. The end cover 32 is made from a plastic material, such as high density polyurethane, and may be manufactured utilizing various molding techniques or machining the end cover 32 from a solid. One skilled in the art would appreciate that the end cover 32 could be used on both ends of the mantel 20 to possibly simply the molding process of the mantel 20, allow the user to cut on both ends of the mantel 20 and base 22 or create a symmetrical appearance with end covers on both ends of the mantel 20.

Figure 7:
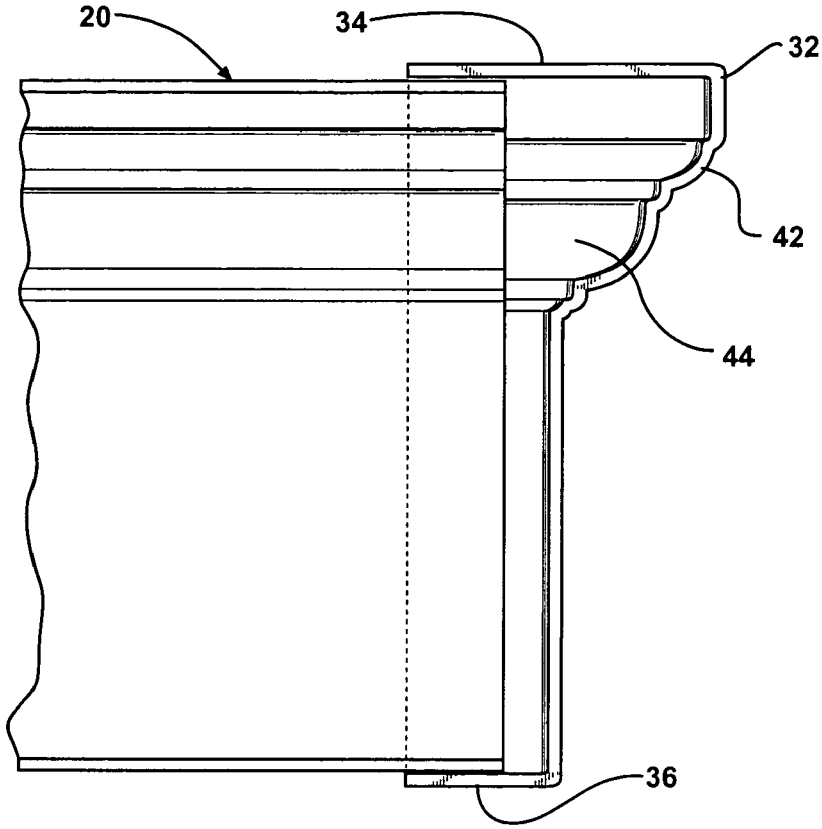
FIG. 7 is a rear view of the end cover disposed on the mantel to show that the end cover overlies the mantel.
Figure 11:
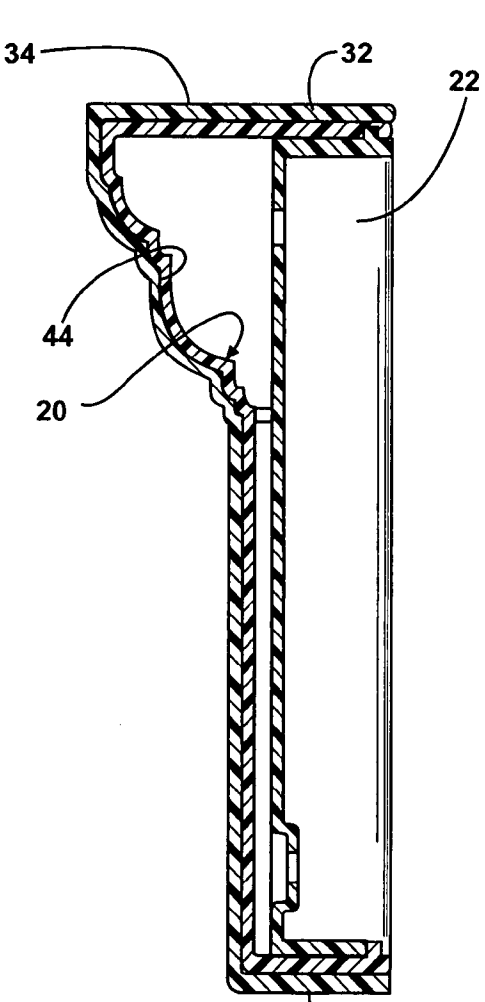
FIG. 11 is a cross-sectional view taken at line 11-11 in FIG. 3 showing the end cover includes front walls with interior surfaces complementary to the decorative surface of the mantel.
Figure 10:
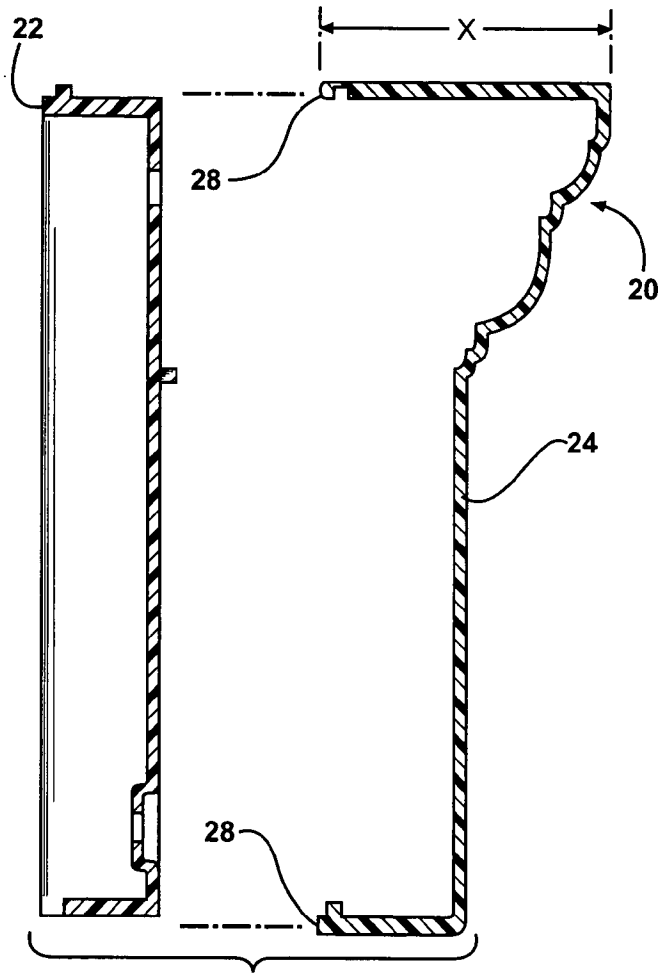
FIG. 10 is an exploded cross-sectional view of FIG. 9.
Figure 9:
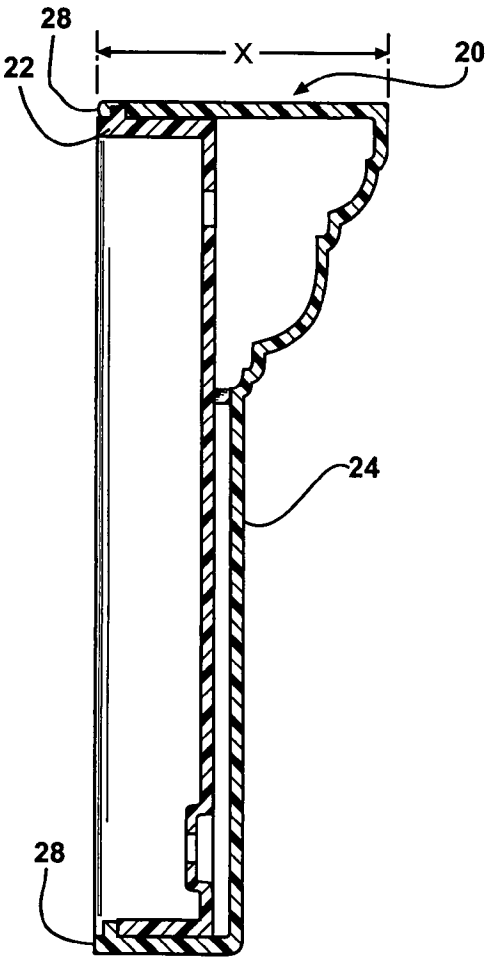
FIG. 9 is a cross-sectional view taken at line 9-9 in FIG. 2 to show a mechanical snap-on device for snapping the mantel onto the base.
Figure 12:
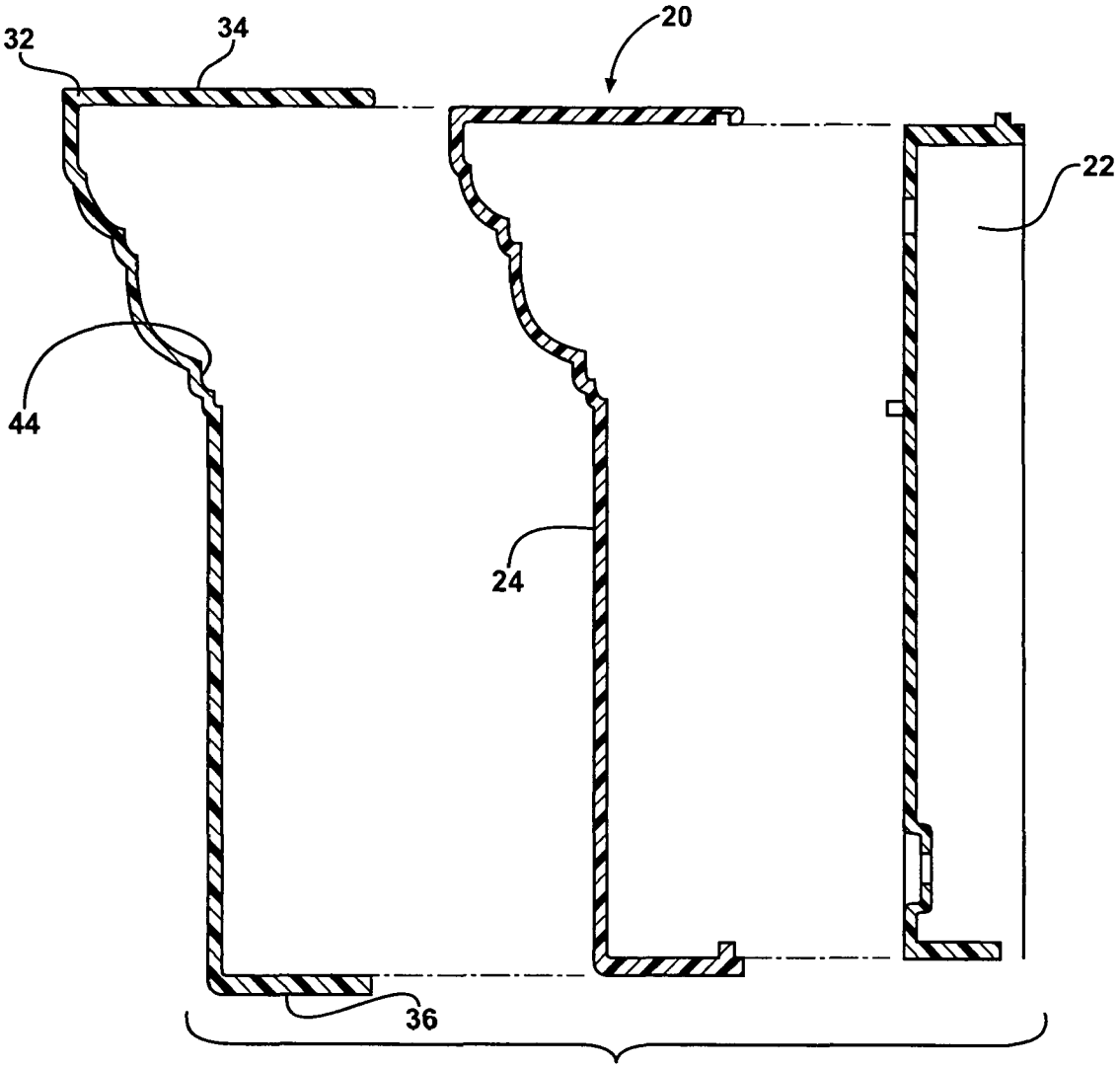
FIG. 12 is an exploded cross-sectional view of FIG. 11.

The front surfaces 40 of the end cover 32 are defined by front walls 44 having interior surfaces complementary to the irregular pattern of the decorative face 24 of the mantel 20, as best shown in FIGS. 11 and 12. Accordingly, the end cover 32 overlies the mantel 20 the thickness of each front wall 44, as shown in FIG. 7.

Figure 8:
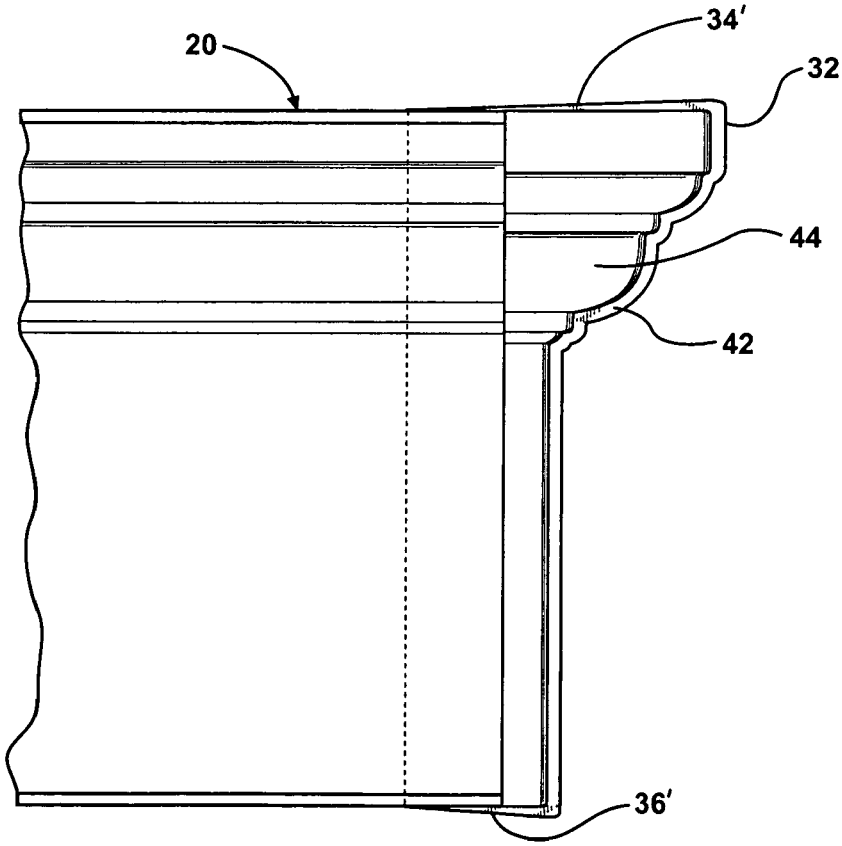
FIG. 8 is a rear view like FIG. 7 but showing the upper and lower walls of the end cover tapering taper into the mantel.

In the modification of FIG. 8, each front wall 44 and the upper wall 34' and the lower wall 36' taper into the mantel 20.

In the modification of FIGS. 5 and 6, each front wall 44 includes score lines 46 for facilitating removal of a portion of the front wall 44 to receive the protrusion 30 adjacent the end of the mantel 20 and under the end cover 32.

Figure 3:
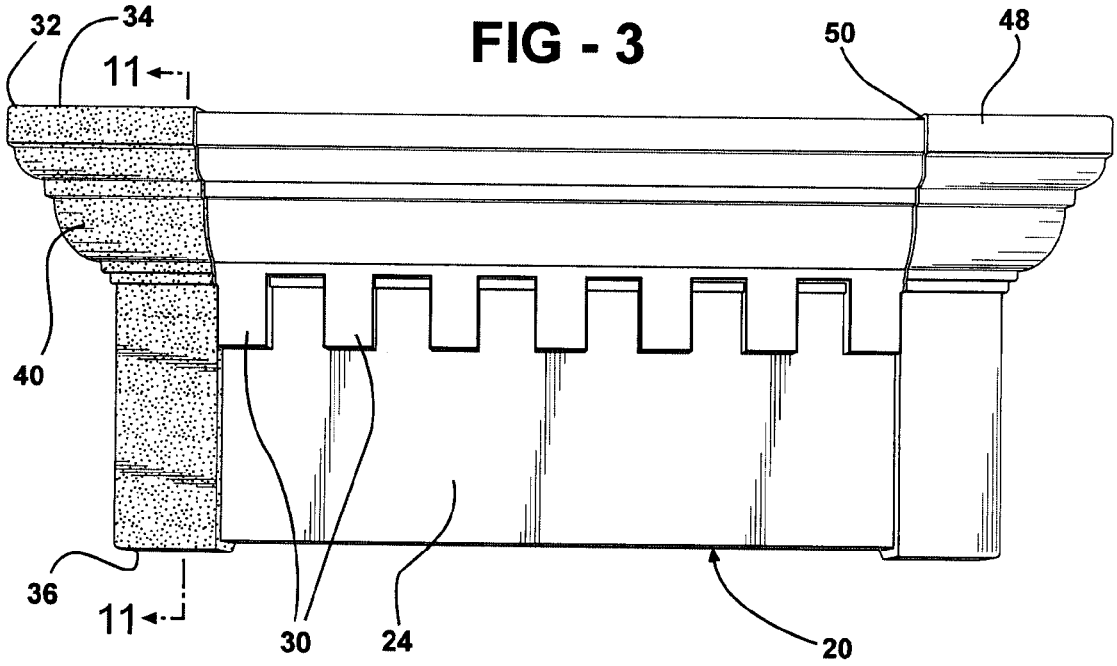
FIG. 3 is an elevational view showing the end cover of the subject invention on one end of the mantel with a simulated cover integrally formed on the other end of the mantel.

In the modification of FIG. 3, the end cover 32 is disposed on one end of the mantel 20 but a simulated cover 48 is integrally formed with the mantel 20 at the other end thereof with the simulated cover 48 presenting a shoulder 50 simulating the thickness of each front wall 44 of the end cover 32.

A mechanical attachment is included for attaching the end cover 32 to the mantel 20. Such attachments may take many forms but are illustrated here as snap together devices. The end cover 32 includes a tab 52, as shown in FIG. 4, which allows the end cover 32 to snap together with the base 22 of the trim assembly. In addition, an additional end plate 54 may be used to attach the end cover 32 as shown in FIG. 1. One skilled in the art would appreciate that the end cover 32 could alternatively be attached to the trim assembly by the use of an adhesive, a fastener or a plug and hole combination as known in the art.

The foregoing invention has been described in accordance with the relevant legal standards; thus, the description is exemplary rather than limiting in nature. Variations and modifications to the disclosed embodiments may become apparent to those skilled in the art and do come within the cope of the invention. Accordingly, the scope of legal protection afforded this invention can only be determined by studying the following claims. In addition, the reference numerals in the claims are merely for convenience and are not to be read in any way as limiting.

ELEMENT LIST

| Element Symbol | Element Name |
|---|---|
| 20 | mantel |
| 22 | base |
| 24 | face |
| 26 | ledge |
| 28 | lip |
| 30 | protrusions |
| 32 | end cover |
| 34 | upper wall |
| 36 | lower wall |
| 38 | front corner |
| 40 | front surfaces |
| 42 | side edges |
| 44 | front walls |
| 46 | score lines |
| 48 | simulated cover |
| 50 | shoulder |
| 52 | tab |
| 54 | end plate |

What is claimed is:

1. An exterior trim assembly (18) for use in a surround of an opening in a building and comprising:

a mantel (20) extending along a longitudinal axis between ends for disposition above the opening in the building;

said mantel (20) defining a rear mounting plane and a decorative face (24) spaced forwardly from said plane a decorative distance (X);

said mantel (20) includes a ledge (26) extending from said decorative face (24) rearwardly to an edge defining said rear mounting plane and said decorative face (24) extends downwardly from said ledge (26) in an irregular pattern having different distances from said mounting plane;

an end cover (32) for disposition over and concealing an end of said mantel (20);

said end cover (32) having a top and a bottom and presenting a front corner (38) extending between said top and said bottom and being symmetrical from said front corner (38) whereby said end cover (32) may be disposed over either end of said mantel (20);

said end cover (32) including two front surfaces (40) extending from said front corner (38) to a respective pair of side edges (42), the distance perpendicular to either of said front surfaces (40) from said front corner (38) to a position aligned with either of said side edges (42) being equal to one another;

said front surfaces (40) of said end cover (32) being defined by front walls (44) having interior surfaces complementary to said irregular pattern of said decorative face (24) of said mantel (20);

said end cover (32) includes an upper wall (34) at said top extending between said front surfaces (40) and said side edges (42) and a lower wall (36) at said bottom extending between said front surfaces (40) and said side edges (42);

each of said upper wall (34) and said lower wall (36) has the shape of a parallelogram having equal sides and;

wherein said top is located above said bottom regardless of which end said end cover (32) is disposed, and wherein said end cover (32) is flush with said rear mounting plane.

2. An assembly as set forth in claim 1 wherein each parallelogram defines a square.

3. An assembly as set forth in claim 1 including an attachment for attaching said end cover (32) to said mantel (20).

4. An assembly as set forth in claim 1 wherein said end cover (32) overlies said mantel (20) by the thickness of said front walls (44).

5. An exterior trim assembly (18) for use in a surround of an opening in a building, the exterior trim assembly comprising:

a mantel (20) extending along a longitudinal axis between ends for disposition above the opening in the building;

said mantel (20) defining a rear mounting plane and a decorative face (24) spaced forwardly from said plane by less than a decorative distance (X);

an end cover (32) for disposition over an end of said mantel (20) and projecting forward from said rear mounting plane by the decorative distance (X);

said end cover (32) having a top and a bottom and presenting a front corner (38) extending between said top and said bottom and being symmetrical from said front corner (38) whereby said end cover (32) may be disposed over either end of said mantel (20);

wherein said end cover (32) includes two front surfaces (40) extending from said front corner (38) to a respective pair of side edges (42), the distance perpendicular to either of said front surfaces (40) from said corner to a position aligned with either of said edges being equal to one another;

wherein said end cover (32) includes an upper wall (34) at said top extending between said front surfaces (40) and said side edges (42) and a lower wall (36) at said bottom extending between said front surfaces (40) and said side edges (42);

wherein each of said upper wall (34) and said lower wall (36) has the shape of a parallelogram having equal sides;

wherein said mantel (20) includes a ledge (26) extending from the decorative face (24) rearwardly to an edge defining the rear mounting plane and said decorative face (24) extends downwardly from said ledge (26) in an irregular pattern having different distances from said mounting plane, said front surfaces (40) of said end cover (32) being defined by front walls (44) having interior surfaces complementary to said irregular pattern;

wherein said end cover (32) overlies said mantel (20) by the thickness of said front walls (44); and wherein at least one of said front walls (44) and said upper wall (34) and said lower wall (36) taper into said mantel (20).

6. An assembly as set forth in claim 4 wherein said end cover (32) is disposed on one end of said mantel (20) and including a simulated cover (48) integrally formed with said mantel (20) at the other end thereof with said simulated cover (48) presenting a shoulder (50) simulating the thickness of said front walls (44) of said end cover (32).

7. An assembly as set forth in claim 4 wherein said mantel (20) includes protrusions (30) spaced along said decorative surface and said front walls (44) include score lines (46) for facilitating removal of a portion of said front walls (44) to receive said protrusion (30) adjacent said end of said mantel (20).

8. An assembly as set forth in claim 4 including a base (22) for attachment to a support structure of a building and for mounting said mantel (20) and said end cover (32).

9. An assembly as set forth in claim 8 including mechanical snap-on devices for snapping said mantel (20) onto said base (22).

10. An exterior trim assembly (18) for use in a surround of an opening in a building, said exterior trim assembly (18) comprising:

a mantel (20) extending along a longitudinal axis between ends for disposition above the opening in the building;

said mantel (20) defining a rear mounting plane and a decorative face (24) spaced forwardly from said plane a decorative distance (X);

said mantel (20) includes a ledge (26) extending from said decorative face (24) rearwardly to an edge defining said rear mounting plane and said decorative face (24) extends downwardly from said ledge (26) in an irregular pattern having different distances from said mounting plane;

an end cover (32) for disposition over and concealing an end of said mantel (20);

said end cover (32) having a top and a bottom and presenting a front corner (38) extending between said top and said bottom and being symmetrical from said front corner (38) whereby said end cover (32) may be disposed over either end of said mantel (20);

said end cover (32) including two front surfaces (40) extending from said front corner (38) to a respective pair of side edges (42), the distance perpendicular to either of said front surfaces (40) from said front corner (38) to a position aligned with either of said side edges (42) being equal to one another;

said front surfaces (40) of said end cover (32) being defined by front walls (44) having interior surfaces complementary to said irregular pattern of said decorative face (24) of said mantel (20); and wherein said top is located above said bottom regardless of which end said end cover (32) is disposed, and wherein said end cover (32) is flush with said rear mounting plane.

* * * * *